United States Patent [19]

Isizuka

[11] 4,229,145

[45] Oct. 21, 1980

[54] SWASH PLATE COMPRESSOR

[75] Inventor: Yutaka Isizuka, Higashimatsuyama, Japan

[73] Assignee: Diesel Kiki Co., Ltd., Tokyo, Japan

[21] Appl. No.: 763,178

[22] Filed: Jan. 27, 1977

Related U.S. Application Data

[63] Continuation of Ser. No. 606,276, Aug. 20, 1975, abandoned.

[51] Int. Cl.[3] ..... F04B 1/14

[52] U.S. Cl. ..... 417/269

[58] Field of Search ..... 417/269

[56] References Cited

U.S. PATENT DOCUMENTS

| | | | |
|---|---|---|---|
| 3,838,942 | 10/1974 | Pohorny | 417/269 |
| 3,888,604 | 6/1975 | Oshima | 417/269 |
| 3,904,320 | 9/1978 | Kishi | 417/269 |
| 3,999,893 | 12/1976 | Kishi | 417/269 |
| 4,070,136 | 1/1978 | Narayama et al. | 417/269 |

*Primary Examiner*—William L. Freeh

*Attorney, Agent, or Firm*—Jordan and Hamburg

[57] ABSTRACT

The bottom portion of a swash plate extends into oil in a sump to splash oil onto the remainder of the swash plate and the members connecting the swash plate to pistons. The splashed oil is partially atomized in a portion of the sump above the liquid oil level, from which a passageway leads to an inlet chamber. The passageway extends through radial and thrust bearings for the swash plate drive shaft. The low pressure in the inlet chamber causes atomized oil from the sump to flow through the passageway and lubricate the radial and thrust bearings. A clearance is provided around the pistons to pressurize the sump and increase the flow rate of oil through the passageway.

3 Claims, 5 Drawing Figures

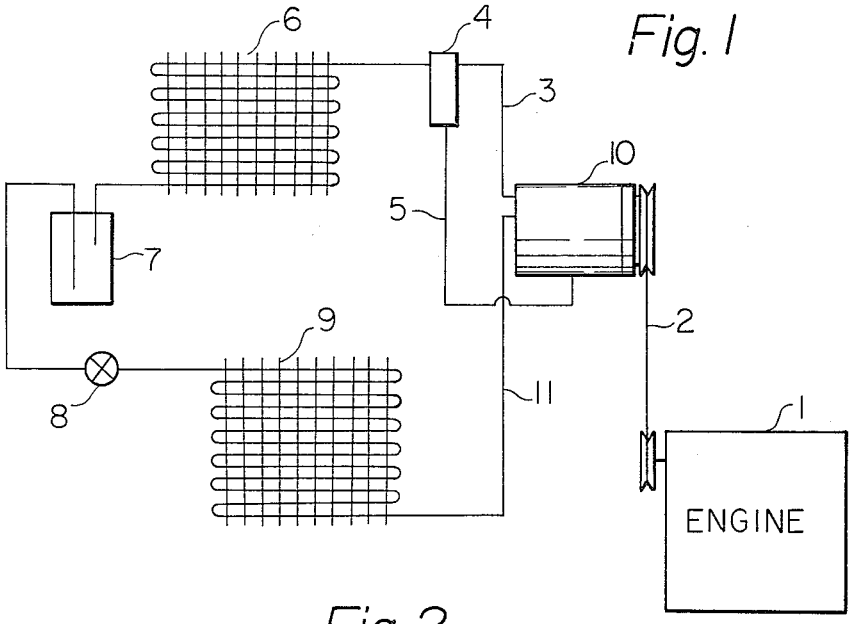
Fig. 1
Fig. 2
PRIOR ART
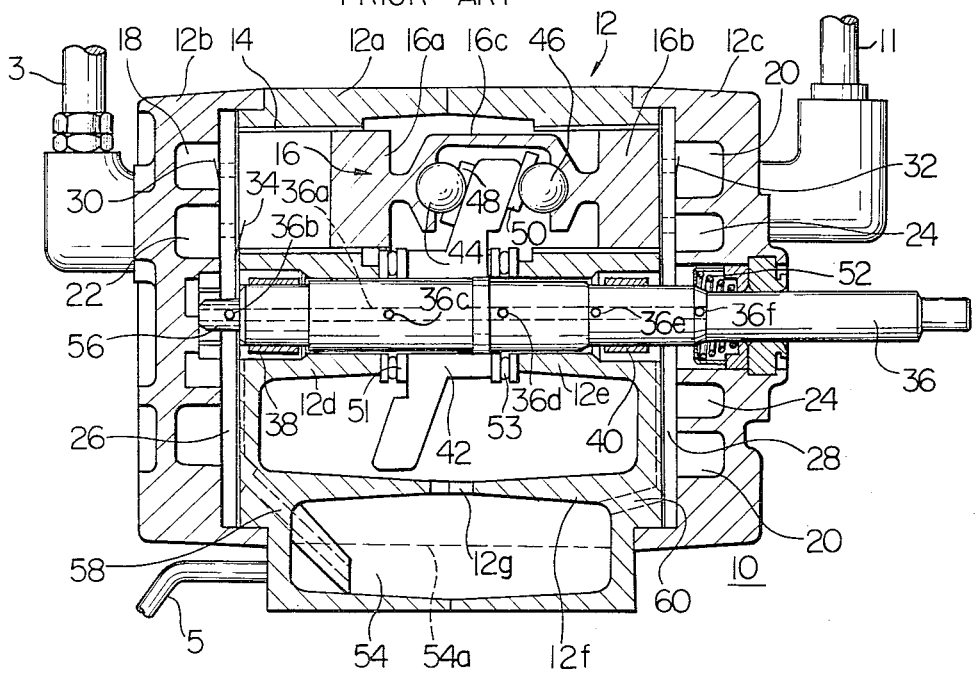

Fig. 3
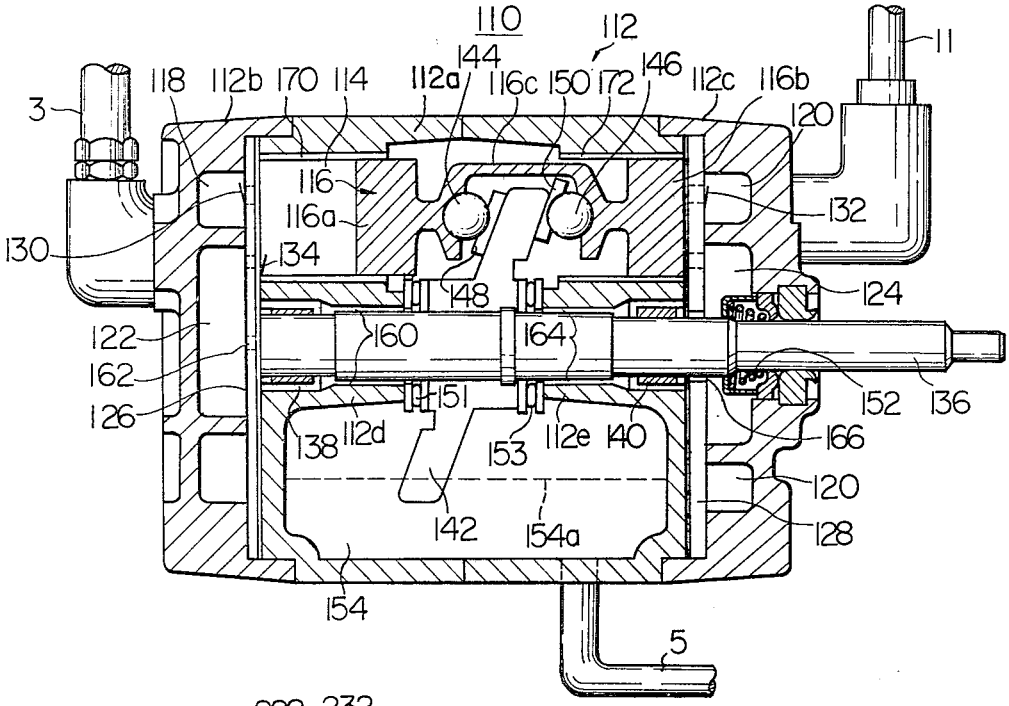
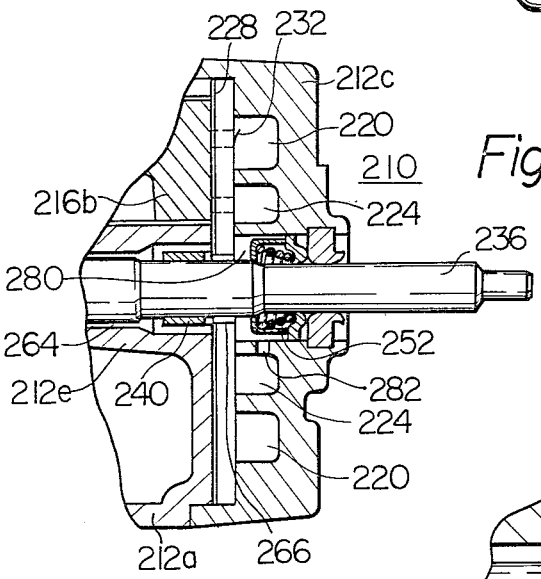
Fig. 4
Fig. 5
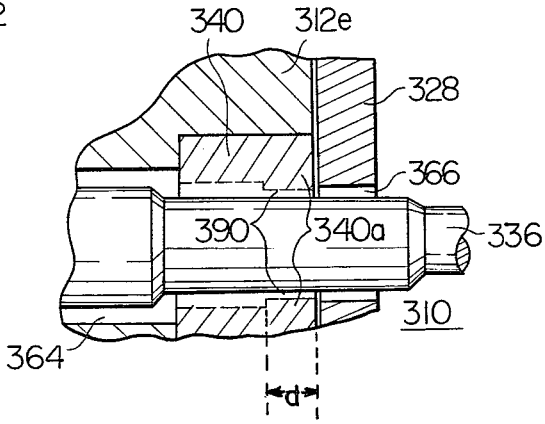

SWASH PLATE COMPRESSOR

This is a continuation of application Ser. No. 606,276, filed Aug. 20, 1975, now abandoned.

The present invention relates to an improved swash plate compressor especially suited to a motor vehicle air conditioning system which provides effective lubrication of moving parts without an oil pump.

In a swash plate compressor such as disclosed in, for example, U.S. Pat. No. 3,057,545 to Ransom et al, a swash plate drive shaft is provided with an axial passageway and a gear pump is provided to force oil from a sump into the axial passageway. Radial passageways lead from the axial passageway to bearings and seals for the drive shaft and members connecting the swash plate to pistons to lubricate the same. The disadvantages of this prior art compressor are that a gear or similar oil pump is required as well as axial and radial passageways through the drive shaft.

It is therefore an object of the present invention to provide an improved swash plate compressor which does not comprise an oil pump.

It is another object of the present invention to provide a swash plate compressor which utilizes the pressure difference between an oil sump and an inlet chamber to cause oil flow to bearings and other moving parts.

It is another object of the present invention to provide a swash plate compressor which provides clearances around pistons to pressurize an oil sump.

It is another object of the present invention to provide a swash plate compressor in which the swash plate is partly immersed in oil in an oil sump to splash oil onto the moving parts of the compressor.

The above and other objects, features and advantages of the present invention will become clear from the following detailed description taken with the accompanying drawings, in which:

FIG. 1 is a schematic view of a known automobile air conditioning system to which a swash plate compressor in accordance with the present invention is directed;

FIG. 2 is a longitudinal sectional view of a prior art swash plate compressor;

FIG. 3 is a longitudinal sectional view of a swash plate compressor in accordance with the present invention;

FIG. 4 is a partial sectional view illustrating a modification of the compressor shown in FIG. 3; and FIG. 5 is a partial sectional view showing another modification of the compressor shown in FIG. 3.

Referring now to FIG. 1, a typical automobile air conditioning system comprises a known swash plate compressor 10 driven by an automobile engine 1 through a belt 20. An outlet pipe 3 leads from the compressor 10 to an oil separator 4, and an oil return pipe 5 leads from the oil separator 4 to an oil sump (not shown in FIG. 1) of the compressor 10. The outlet of the oil separator 4 is connected through a radiator 6 to a refrigerant fluid container 7. The container 7 is connected through an expansion valve 8, an evaporator 9 and an inlet pipe 11 to the compressor 10.

In operation, refrigerant fluid is forced by the compressor 10 through the outlet pipe 3 and oil separator 4 into the radiator 6. Lubricating oil entrained in the refrigerant fluid is returned to the compressor 10 through the oil return pipe 5. The refrigerant fluid is in gaseous form in the compressor 10, but the combination of the increase in pressure in the compressor 10 and heat radiated to the atmosphere through the radiator 6 causes the refrigerant fluid to condense into liquid form in the radiator 6 and be stored in the container 7. Refrigerant fluid from the container 7 undergoes a pressure drop in the expansion valve 8 and an extreme drop in temperature and emerges from the expansion valve 8 in cold gaseous form. In the evaporator 9, the refrigerant fluid absorbs heat from the cabin (not shown) of the automobile thereby cooling the same and passes through the inlet pipe 11 to the compressor 10. Such a refrigeration system is well known in the art.

Referring now to FIG. 2, the prior art compressor 10 comprises a housing 12 which is composed of a block **12*a* and heads 12*b* and 12*c*. The block 12*a* is formed with a plurality of piston chambers or bores, only one of which is visible in FIG. 2 and designated as 14. A double acting piston 16 is slidingly received in the bore 14 and is composed of left and right piston heads 16*a* and 16*b* respectively integrally joined by a connecting portion 16*c*. The outlet pipe 3 is connected to outlet chambers 18 and 20 (although the connection is not visible in FIG. 2) and the inlet pipe 11 is similarly connected to inlet chambers 22 and 24 in the heads 12*b* and 12*c* respectively. A valve plate 26 is disposed between the head 12*b* and the block 12*a* and a valve plate 28 is disposed between the head 12*c* and the block 12*a***.

The piston 16, bore 14 and valve plates 26 and 28 define working chambers (no numerals) opposite the left and right faces of the piston heads **16*a* and 16*b* which communicate with the outlet chambers 18 and 20 through outlet valves 30 and 32 provided to the valve plates 26 and 28. The valve plate 26 is provided with an inlet valve 34 which provides communication between the bore 14 and the inlet chamber 22. A similar inlet valve is provided for communication between the bore 14 and the inlet chamber 24** which is not visible in FIG. 2.

The housing 12 is further provided with hubs **12*d* and 12*e* which rotatably support a drive shaft 36 by means of radial bearings 38 and 40. A swash plate 42 is fixed to the shaft 36 for unitary rotation and engages with the piston 16 by means of drive balls 44 and 46 and bearing shoes 48 and 50. A drive shaft seal 52 is provided at the right end of the head 12*c*. Thrust bearings 51 and 53 are disposed between the swash plate 42 and the hubs 12*d* and 12*e*** respectively.

The housing 12 is further provided with a lower partition **12*f* which is formed with a hole 12*g* and defines a lubricant reservoir or sump 54 which is filled with lubricating oil up to a level indicated by a broken line 54*a*. The oil return pipe 5 opens into the sump 54. A gear type oil pump 56 is driven by the drive shaft 36 and communicates with the oil in the sump 54 through a passageway 58. The oil pump 56 is adapted to pump oil from the sump 54 into an axial passageway 36*a* formed in the drive shaft 36. Radial holes 36*b*, 36*c*, 36*d*, 36*e* and 36*f* communicating with the axial passageway 36*a* are formed in the drive shaft 36 adjacent to the radial bearing 38, thrust bearing 51, thrust bearing 53, radial bearing 40 and shaft seal 52 respectively. An oil return passageway 60 leads from the shaft seal 52 to the sump 54**.

In operation, the drive shaft 36 is rotated by the engine 1 so that the swash plate 42 also rotates. Since the swash plate 42 is disposed at an angle to the shaft 36 as shown, rotation of the swash plate 42 causes the piston 16 to reciprocate left and right as viewed in FIG. 2. As the piston 16 is moved rightward, refrigerant fluid is sucked through the inlet pipe 11, inlet chamber 22 and inlet valve 34 into the working chamber defined by the left face of the piston head 16*a*. Simultaneously, refrigerant fluid is forced from the working chamber defined by the right face of the piston head 16*b* through the outlet valve 32 and outlet chamber 20 into the outlet pipe 3. As the piston 16 is moved leftward, refrigerant fluid is forced from the working chamber defined by the left face of the piston head 16*a* through the outlet valve 30 and outlet chamber 18 into the outlet pipe 3. Simultaneously, refrigerant fluid is sucked from the inlet pipe 11 through the inlet chamber 24 and inlet valve which is not visible in FIG. 2 into the working chamber defined by the right face of the piston head 16*b*. In this manner, the compressor 10 serves to pump refrigerant fluid from the inlet pipe 11 to the outlet pipe 3.

Regarding lubrication, the prior art compressor 10 shown in FIG. 2 serves to lubricate the moving parts thereof in the following manner. The gear oil pump 56 forces oil from the sump 54 into the axial passageway 36*a* of the drive shaft 36. Oil flows from the axial passageway 36*a* through the radial passageways 36*b* and 36*e* to lubricate the radial bearings 38 and 40 respectively. Oils flows from the axial passageway 36*a* through the radial passageways 36*c* and 36*d* to lubricate the thrust bearings 51 and 53 and also the swash plate 42, drive balls 44 and 46 and bearing shoes 48 and 50. Oil discharged from the bearings 38, 40, 51 and 53 is returned to the sump 54 through the hole 12*g*. Oil flowing from the axial passageway 36*a* through the radial passageway 36*f* lubricates the shaft seal 52, and this oil is returned to the sump 54 through the oil return passageway 60.

It will be noticed that the prior art compressor 10 shown in FIG. 2 comprises the oil pump 56 and passageways 36*a* to 36*f* to provide the required lubrication of the moving parts of the compressor 10. The present invention proposes to replace the prior art compressor 10 with a compressor 110 embodying the present invention which is so constructed as to perform lubrication of the moving parts thereof without an oil pump or passageways formed in a drive shaft and thereby represents a significant saving in manufacturing labor and expense.

Referring now to FIG. 3, the compressor 110 comprises a housing 112 which is composed of a block 112*a* and heads 112*b* and 112*c*. The block 112*a* is formed with a plurality of piston chambers or bores, only one of which is visible in FIG. 3 and designated as 114. A double acting piston 116 is slidingly received in the bore 114 and is composed of left and right piston heads 116*a* and 116*b* respectively integrally joined by a connecting portion 116*c*. The outlet pipe 3 is connected to outlet chambers 118 and 120 and the inlet pipe 11 is connected to inlet chambers 122 and 124 in the heads 112*b* and 112*c* respectively. A valve plate 126 is disposed between the head 112*b* and the block 112*a* and a valve plate 128 is disposed between the head 112*c* and the block 112*a*.

The piston 116, bore 114 and valve plates 126 and 128 define working chambers (no numerals) opposite the left and right faces of the piston heads 116*a* and 116*b* which communicate with the outlet chambers 118 and 120 through outlet valves 130 and 132 provided to the valve plates 126 and 128. The valve plate 126 is provided with an inlet valve 134 which provides communication between the bore 114 and the inlet chamber 122. A similar inlet valve is provided for communication between the bore 114 and the inlet chamber 124 which is not visible in FIG. 3.

The housing 112 is further provided with hubs 112*d* and 112*e* which rotatably support a drive shaft 136 by means of radial needle bearings 138 and 140. A swash plate 142 is fixed to the shaft 136 for unitary rotation and engages with the piston 116 by means of drive balls 144 and 146 and bearing shoes 148 and 150. A drive shaft seal 152 is provided at the right end of the head 112*c* in the inlet chamber 124. Thrust bearings 151 and 153 are disposed between the swash plate 142 and the hubs 112*d* and 112*e* respectively.

The bottom portion of the housing 112 constitutes a lubricant reservoir or sump 154 which is filled with liquid lubricating oil up to a liquid oil level indicated by a broken line 154*a*. The oil return pipe 5 opens into the sump 154. Similar to the prior art compressor shown in FIG. 2.

The drive shaft 136 is rotated by the engine 1 so that the swash plate 142 also rotates. Since the swash plate 142 is disposed at an angle to the shaft 136 as shown, rotation of the swash plate 142 causes the piston 116 to reciprocate left and right as viewed in FIG. 3. As the piston 116 is moved rightward, refrigerant fluid is sucked through the inlet pipe 11, inlet chamber 122 and inlet valve 134 into the working chamber defined by the left face of the piston head 116*a*. Simultaneously, refrigerant fluid is forced from the working chamber defined by the right face of the piston head 116*b* through the outlet valve 132 and outlet chamber 120 into the outlet pipe 3. As the piston 16 is moved leftward, refrigerant fluid is forced from the working chamber defined by the left face of the piston head 116*a* through the outlet valve 130 and outlet chamber 118 into the outlet pipe 3. Simultaneously, refrigerant fluid is sucked from the inlet pipe 11 through the inlet chamber 124 and inlet valve which is not visible in FIG. 3 into the working chamber defined by the right face of the piston head 116*b*. In this manner, the compressor 110 serves to pump refrigerant fluid from the inlet pipe 11 to the outlet pipe 3.

Although the basic pumping operation of the compressor 110 is similar to that of the prior art compressor 10, the construction and operation of the lubricating system is different and novel. In FIG. 3, it will be seen that the bottom portion of the swash plate 142 extends into the liquid oil in the sump 154, or below the liquid oil level 154*a*. By this construction, the swash plate 142 serves to splash oil from the sump 154 within the housing 112 in a turbulent manner so as to splash oil onto the remainder of the swash plate 142, onto the drive balls 144 and 146, the bearing shoes 148 and 150 and the piston 116. It has been found in practice that this construction ensures effective lubrication of the above mentioned components. Furthermore, the turbulent oil splashing action of the swash plate 142 serves to atomize a substantial amount of oil in the portion of the sump 154 above the liquid oil level 154*a*.

In accordance with a novel feature of the present invention, passageways are provided between the portion of the sump 154 above the liquid oil level 154*a* and the inlet chambers 122 and 124. Due to the inherent construction of the radial needle bearings 138 and 140, clearances are provided between the needles (not shown) so that fluid may pass axially through the bearings 138 and 140. Similarly, the thrust bearings 151 and 153 are so constructed that fluid may pass through clearances therein in both the radial and axial directions.

The hub 112*d* is formed with a bore 160 which has a diameter larger than the diameter of the drive shaft 136 so that a clearance is provided between the drive shaft 136 and hub 112*d*. A hole 162 is provided through the valve plate 126 which provides communication between the radial bearing 138 and the inlet chamber 122. A first passageway is therefore provided which is constituted by the clearances in the thrust bearing 151, the portion of the bore 160 in the hub 112*d* constituting the clearance between the drive shaft 136 and the hub 112*d*, the clearances in the radial needle bearing 138 and the hole 162 which provides communication between the sump 154 and the inlet chamber 122.

Due to the operation of the compressor 110, the fluid pressure in the inlet chamber 122 is much lower than that in the sump 154. This pressure difference causes the atomized oil in the sump 154 to flow through said passageway thereby effectively lubricating the thrust bearing 151 and radial needle bearing 138.

In a similar manner a second passageway between the sump 154 and the inlet chamber 124 is constituted by clearances in the thrust bearing 153, a bore 164 in the hub 112*e* having a diameter larger than that of the drive shaft 136 and a hole 166 through the valve plate 128 having a diameter larger than that of the drive shaft 136. Atomized oil from the sump 154 is caused to flow through said passageway by the pressure difference between the inlet chamber 124 and the sump 154 to lubricate the thrust bearing 153 and radial needle bearing 140. Since the drive shaft seal 152 is disposed in the inlet chamber 124, it also is lubricated by the flow of atomized oil. The atomized oil pumped through the bore 114 by the piston 116 into the outlet pipe 3 is separated from the refrigerant fluid by the oil separator 4 and returned to the sump 154 by through the return pipe 5.

In accordance with another important feature of the present invention, small clearances 170 and 172 constituting a third passageway are provided between the outer surface of the piston 116 and the inner surface of the bore 114 through which a restricted amount of refrigerant fluid is allowed to leak from the working chambers in the bore 114 into the sump 154. Since the clearances 170 and 172 are small, this leakage will only occur during the compression strokes of the piston heads 116*b* so that the leaked refrigerant fluid will be of high pressure. This will have the effect of pressurizing the oil sump 154 or raising the pressure of the refrigerant fluid and entrained atomized oil in the portion of the sump 154 above the liquid oil level 154*a*. This will increase the pressure difference between the inlet chambers 122 and 124 and the oil sump 154 and increase the flow rate of oil through said passageways.

A modification of the embodiment of FIG. 3 is shown in FIG. 4, in which a compressor 210 includes a drive shaft 236 rotatably supported in a housing block 212*a* and head 212*c* by a hub 212*e* and radial bearing 240 in an identical manner to the compressor 110. A bore 264 is provided in the hub 212*e* which has a diameter larger than the shaft 236 and a hole 266 is formed in a valve plate 228 which has a diameter larger than the shaft 236. A piston head 216*b*, outlet valve 232 and outlet chamber 220 are also shown which are identical to FIG. 3. Whereas in FIG. 3 the drive shaft seal 152 is disposed in the inlet chamber 124, in FIG. 4 a drive shaft seal 252 is disposed in a drive shaft seal chamber 280. The hole 266 in the valve plate 228 provides communication between the radial bearing 240 and the drive shaft seal chamber 280. An inlet chamber 224 communicates with the drive shaft seal chamber 280 through a hole 282. In operation, atomized oil flows through the bore 264 in the hub 212*e* and the radial bearing 240 to lubricate the bearing 240 and through the hole 266, seal chamber 280 and hole 282 to lubricate the drive shaft seal 252.

A further modification to the compressor 110 is illustrated in FIG. 5 as a compressor 310 comprising a drive shaft 336 extending through a bore 364 in a hub 312*e* and a hole 366 in a valve plate 328. In this case, a journal bearing 340 is fixed in the hub 312*e* to rotatably support the drive shaft 336. A small clearance 390 is provided between a sliding contact portion 340*a* of the shaft 336 and bearing 340 through which atomized oil may flow between the bore 364 and hole 366. The pressure difference between the bore 364 and hole 366 may be optimally provided by selection of the clearance 390 and the width d of the sliding contact portion 340*a*.

Other modifications will become possible to those skilled in the art after receiving the teachings of the present disclosure.

What is claimed is:

1. A swash plate compressor comprising, in combination:

a housing defining an inlet chamber having an inlet pipe through which refrigerant fluid is introduced, an outlet chamber having an outlet pipe and a piston chamber, the housing being provided with first and second hubs, a bottom portion of the housing constituting a lubricating fluid reservoir containing liquid oil;

a piston reciprocally slidable in the piston chamber;

valve means operatively connecting the piston chamber to the inlet and outlet chambers and comprising first and second valve plates, each being formed with a hole;

a drive shaft rotatably supported within the housing, the drive shaft extending through the hubs of the housing and the hole of the second valve plate, the diameter of the hole of the second valve plate being larger than the diameter of the drive shaft;

a swash plate fixed for rotation with the drive shaft and being operatively connected to the piston to reciprocate the piston in the piston chamber, the swash plate being arranged to partially extend below a lubricating liquid oil level in the reservoir to thereby splash the oil within the housing and atomize the oil in a portion of the reservoir above the liquid oil level;

first and second thrust bearings disposed between the swash plate and the first and second hubs respectively, the first and second valve plates being disposed between the inlet chamber and the first and second thrust bearings respectively;

first and second journal bearings supported by the first and second hubs respectively within the housing to rotatably support the drive shaft, said journal bearings having a sliding contact portion extending over a longitudinal portion of the journal bearing to slidingly support said drive shaft with a clearance being provided between said sliding contact portion and said drive shaft;

first and second passageways connecting the portion of the reservoir above the liquid oil level with the inlet chamber, the first passageway extending through the portion of the reservoir above the liquid oil level, the first thrust bearing, a first clearance defined between the drive shaft and the hub, the clearance between the drive shaft and the sliding contact portion of the first journal bearing, the hole of the first valve plate and the inlet chamber, the second passageway extending through the portion of the reservoir above the liquid oil level, the second thrust bearing, a second clearance defined between the drive shaft and the second hub, the clearance between the drive shaft and the sliding contact portion of the second journal bearing, the hole in the second valve plate and the inlet chamber, and a third passageway providing communication between the piston chamber and the portion of the reservoir above the liquid oil level, the third passageway comprising third and fourth clearances provided between an outer surface of the piston and the inner surface of the piston chamber, the third and fourth clearances constituting part of the first and second passageways, the longitudinal width of the sliding contact portions of the journal bearings being variable so that the pressure difference between the first clearance and the hole of the first valve plate and the pressure difference between the second clearance and the hole of the second valve plate are optimally provided, whereby the liquid oil is circulated through the first, second and third passageways.

2. A swash plate compressor according to claim 1, in which the housing further defines a drive shaft seal chamber, the compressor further comprising a drive shaft seal disposed in the drive shaft seal chamber, the second passageway extending through the drive shaft seal chamber.

3. A swash plate compressor according to claim 2, in which the drive shaft seal chamber is integral with the inlet chamber.

* * * * *